US009836998B2

(12) United States Patent
Eden

(10) Patent No.: US 9,836,998 B2
(45) Date of Patent: Dec. 5, 2017

(54) BUSINESS CARD HOLDERS

(71) Applicant: Gideon Eden, Ann Arbor, MI (US)

(72) Inventor: Gideon Eden, Ann Arbor, MI (US)

( * ) Notice: Subject to any disclaimer, the term of this patent is extended or adjusted under 35 U.S.C. 154(b) by 25 days.

(21) Appl. No.: 15/094,780

(22) Filed: Apr. 8, 2016

(65) Prior Publication Data

US 2017/0294150 A1 Oct. 12, 2017

(51) Int. Cl.
*G09F 1/10* (2006.01)

(52) U.S. Cl.
CPC ..... *G09F 1/10* (2013.01)

(58) Field of Classification Search
CPC ..... G09F 1/10; G09F 2003/0241
See application file for complete search history.

(56) References Cited

U.S. PATENT DOCUMENTS 3,924,744 A * 12/1975 Heimann ..... B42F 19/00 206/460
4,057,923 A * 11/1977 Chase ..... A47G 1/17 40/769
4,714,276 A * 12/1987 Greig ..... B41L 1/24 281/15.1
4,768,810 A * 9/1988 Mertens ..... B41L 1/26 281/5
4,770,320 A * 9/1988 Miles ..... B42D 5/005 206/39.3
5,194,299 A 3/1993 Fry
5,290,067 A * 3/1994 Langen ..... G09F 3/10 283/60.1
5,890,688 A * 4/1999 Riordan ..... A47G 1/17 248/205.3
6,408,553 B1 * 6/2002 Brown ..... G09F 1/10 248/222.12

* cited by examiner

*Primary Examiner* — Gary C Hoge

(57) ABSTRACT

A document holder system can include a thin surface elongate along a first direction and a second direction that is perpendicular to the first direction. The document holder system can include a first adhesive portion disposed on a back side along a top portion of the thin surface. Additionally, the document holder system can include a second adhesive portion disposed on a front side along at least one of the top portion and a middle portion of the thin surface.

19 Claims, 13 Drawing Sheets

BUSINESS CARD HOLDERS

BACKGROUND

Field

The invention is directed in general to documents, such as business cards, and more specifically, to systems for holding, organizing, and posting business cards.

Description of Related Art

Business people typically use two types of business cards: traditional business cards without adhesive and self-sticking business cards with adhesive. The self-sticking cards usually have adhesive disposed along one side in order to stick the card to various surfaces, such as brochures.

Traditional business cards can be advantageous over self-sticking business cards because traditional cards can include print on both sides. However, one limitation of traditional business cards is that in order to attach them to another surface, a user has to attach traditional business cards with a secondary device, such as a stapler, rubber band, etc.

Self-sticking business cards can be beneficial over traditional business cards because self-sticking cards can be attached to various surfaces without the need of a secondary device. Unfortunately, self-sticking business cards can only be printed on one side and the adhesive has to be covered by a protective film that, when peeled away, renders the self-sticking card unusable as a traditional card that can be given to another person. Moreover, once a self-sticking business card is adhered to a surface it loses its ability to serve as a traditional card. Accordingly, there is a need for systems and methods to remedy the deficiencies of traditional business cards and self-sticking business cards.

SUMMARY

The present disclosure includes a document holder system that includes a thin surface elongate along a first direction and a second direction that is perpendicular to the first direction, wherein the thin surface comprises a front side and a back side that faces opposite the front side. The document holder system also includes a first adhesive portion disposed on the back side along a top portion of the thin surface and a second adhesive portion disposed on the front side along at least one of the top portion and a middle portion of the thin surface, wherein the top portion and the middle portion do not overlap.

The thin surface can further define a bottom portion located opposite the top portion whereby the bottom portion and the middle portion do not overlap. The bottom portion can be devoid of adhesive on both the front side and the back side.

The thin surface can be selected from the group consisting of paper, polymer, and fabric. In some embodiments, the first adhesive portion is adhesively attached to a large document that defines a width that is greater than the first width and the large document defines a height that is greater than the first height. The first adhesive portion can be configured to release the large document without damaging the large document.

The thin surface can define a first width and a first height. In some embodiments, the system further includes a first document adhesively attached to the second adhesive portion. The second adhesive portion can be configured to release the first document without damaging the first document. Additionally, the first document can define a second width that is less than or equal to the first width and the first document can define a second height that is less than the first height. In some embodiments, the first document comprises a business card whereby the second width equals 3.5 inches and the second height equals 2.0 inches.

In some embodiments, the thin surface is a first thin surface and the system further comprises a second thin surface elongate along the first direction and the second direction, wherein the second thin surface comprises a front side and a back side that faces opposite the front side. The system can further include a third adhesive portion disposed on the back side along a top portion of the second thin surface and a fourth adhesive portion disposed on the front side along at least one of the top portion of the second thin surface and a middle portion of the second thin surface. In some embodiments, the top portion of the second thin surface and the middle portion of the second thin surface do not overlap. The first adhesive portion of the first thin surface can be adhesively attached to a top portion of the front side of the second thin surface. In some embodiments, the first adhesive portion is configured to release the second thin surface without damaging the second thin surface. The second thin surface can define a third width that is equal to the first width and the second thin surface can define a third height that is equal to the first height.

The document holder system can further include a second document adhesively attached to the fourth adhesive portion. The fourth adhesive portion can be configured to release the second document without damaging the second document. The second document can define a fourth width that is equal to the second width and the second document can define a fourth height that is equal to the second height.

The document holder system can also include a second thin surface, a third adhesive portion disposed on the back side along a top portion of the second thin surface and a fourth adhesive portion disposed on the back side along a middle portion of the second thin surface. In some embodiments, the top portion and the middle portion do not overlap. The first adhesive portion of the first thin surface can be adhesively attached to a top portion of the front side of the second thin surface. The first adhesive portion can be configured to release the second thin surface without damaging the second thin surface. The second thin surface can define a third width that is equal to the first width and the second thin surface can define a third height that is equal to the first height.

The document holder system can further include a second document adhesively attached to the fourth adhesive portion. The fourth adhesive portion can be configured to release the second document without damaging the second document. The second document can define a fourth width that is equal to the second width and the second document can define a fourth height that is equal to the second height.

In some embodiments, the first thin surface is detached from the second thin surface, and the first adhesive portion is adhesively attached to a large document that defines a fifth width that is greater than the first width and the large document defines a fifth height that is greater than the first height. The first adhesive portion can be configured to release the large document without damaging the large document.

In some embodiments, the second adhesive portion is located on the front side along the top portion and the system further includes a second thin surface, a third adhesive portion disposed on the back side along a top portion of the second thin surface, and a fourth adhesive portion disposed on the front side along a top portion of the second thin surface. The first adhesive portion of the first thin surface can be adhesively attached to the top portion of the front side of the second thin surface. The first adhesive portion can be configured to release the second thin surface without damaging the second thin surface. The second thin surface can define a third width that is equal to the first width and the second thin surface can define a third height that is equal to the first height.

The disclosure also includes a document holder system that includes a thin surface elongate along a first direction and a second direction that is perpendicular to the first direction. The thin surface can comprise a front side and a back side that faces opposite the front side. The document holder system can include a first adhesive portion disposed on the back side along a top portion of the thin surface and a second adhesive portion disposed on one of the front side and the back side along a middle portion of the thin surface. In some embodiments, the top portion and the middle portion do not overlap.

The thin surface can further define a bottom portion located opposite the top portion whereby the bottom portion and the middle portion do not overlap. In some embodiments, the bottom portion is devoid of adhesive and the bottom portion is configured to receive hand-written notes from a writing instrument. The thin surface can comprise paper.

The document holder system can further include a business card adhesively attached to the second adhesive portion. The second adhesive portion can be configured to release the business card without damaging the business card.

In some embodiments, the document holder system can further comprise a first protective film removably attached to the second adhesive portion. The first protective film may not cover any portion of the top portion and the bottom portion of the thin surface.

In some embodiments, the first protective film is removed from the second adhesive portion and the document holder further comprises a business card adhesively attached to the second adhesive portion. The second adhesive portion can be configured to release the business card without damaging the business card. The second adhesive portion can define an area less than or equal to an area of the business card.

In some embodiments, the thin surface is a first thin surface and the system further includes a second thin surface elongate along the first direction and the second direction. The second thin surface can comprise a front side and a back side that faces opposite the front side. The document holder system can further include a third adhesive portion disposed on the back side along a top portion of the second thin surface and a fourth adhesive portion disposed on one of the front side and the back side along a middle portion of the second thin surface. In embodiments, the top portion and the middle portion do not overlap. The first adhesive portion of the first thin surface can be adhesively attached to the top portion of the front side of the second thin surface. The first adhesive portion can be configured to release the second thin surface without damaging the second thin surface.

The document holder system can further include a second protective film removably attached to the fourth adhesive portion. In some embodiments, the second protective film does not cover any portion of the top portion and the bottom portion of the second thin surface.

The document holder system can further include a second thin surface, a third adhesive portion disposed on the back side along a top portion of the second thin surface, and a fourth adhesive portion disposed on the front side along at least one of the top portion of the second thin surface and a middle portion of the second thin surface. In some embodiments, the top portion of the second thin surface and the middle portion of the second thin surface do not overlap. The first adhesive portion of the first thin surface can be adhesively attached to the top portion of the front side of the second thin surface. The first adhesive portion can be configured to release the second thin surface without damaging the second thin surface. The document holder system can also include a second protective film removably attached to the fourth adhesive portion. In some embodiments, the second protective film does not cover any portion of a bottom portion of the second thin surface.

The embodiments described above include many optional features and aspects. Features and aspects of the embodiments can be combined.

BRIEF DESCRIPTION OF THE DRAWINGS

These and other features, aspects, and advantages are described below with reference to the drawings, which are intended to illustrate, but not to limit, the invention. In the drawings, like reference characters denote corresponding features consistently throughout similar embodiments. The above and other features of the present invention will become more apparent by describing in detail exemplary embodiments thereof with reference to the accompanying drawings, in which.

DETAILED DESCRIPTION

Figure 1:
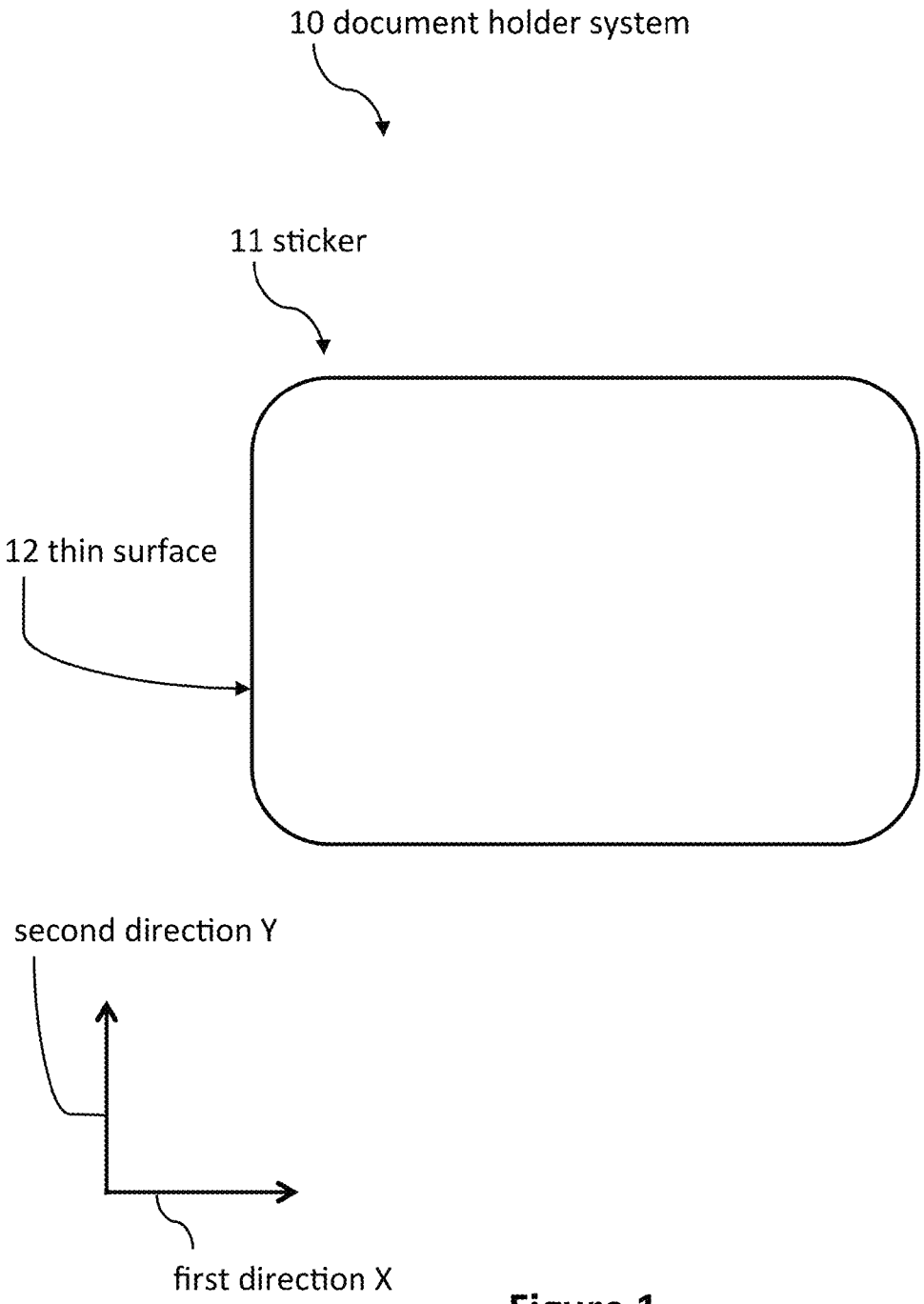
FIG. 1 illustrates a sticker, according to embodiments of the present disclosure.

Although certain embodiments and examples are disclosed below, inventive subject matter extends beyond the specifically disclosed embodiments to other alternative embodiments and/or uses, and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components.

For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

LIST OF REFERENCE NUMERALS

10—Document holder system
11—Sticker
12—Thin surface
14—Back side
16—Front side
18—Top portion
20—Middle portion
22—Bottom portion
24—First adhesive portion
26—Second adhesive portion
28—Protective film
30—First document
32—Large document
34—Third adhesive portion
36—Fourth adhesive portion
40—First width
42—Second width
44—First height
46—Second height The document holder system 10, as disclosed, has all the advantages of traditional business cards, and self-sticking business cards, without any of the deficiencies of either card type. For example, the document holder system 10 can be implemented with documents, such as business cards, that have printing on both sides. Additionally, the document holder system 10 can couple multiple business cards together, and attach one or more of the business cards to other documents or surfaces without the use of secondary devices, such as staples, rubber bands, tape, and the like. Even still, the document holder system 10 can allow the business cards to be attached to or removed from other documents or surfaces without damaging the other documents or surfaces.

Figure 2A:
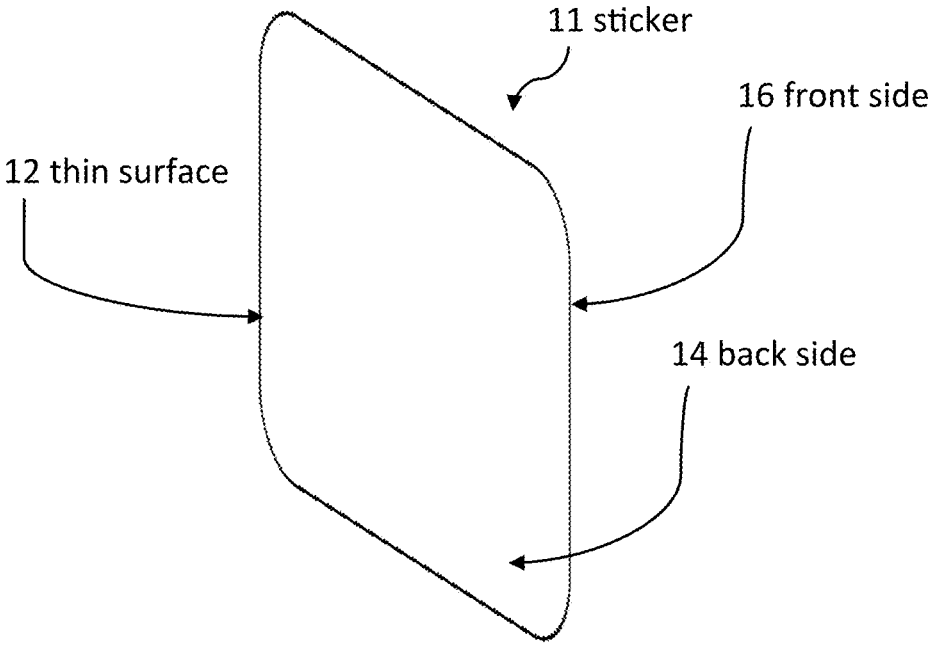
FIG. 2*a* illustrates a back side perspective view of a sticker, according to embodiments of the present disclosure.
Figure 2B:
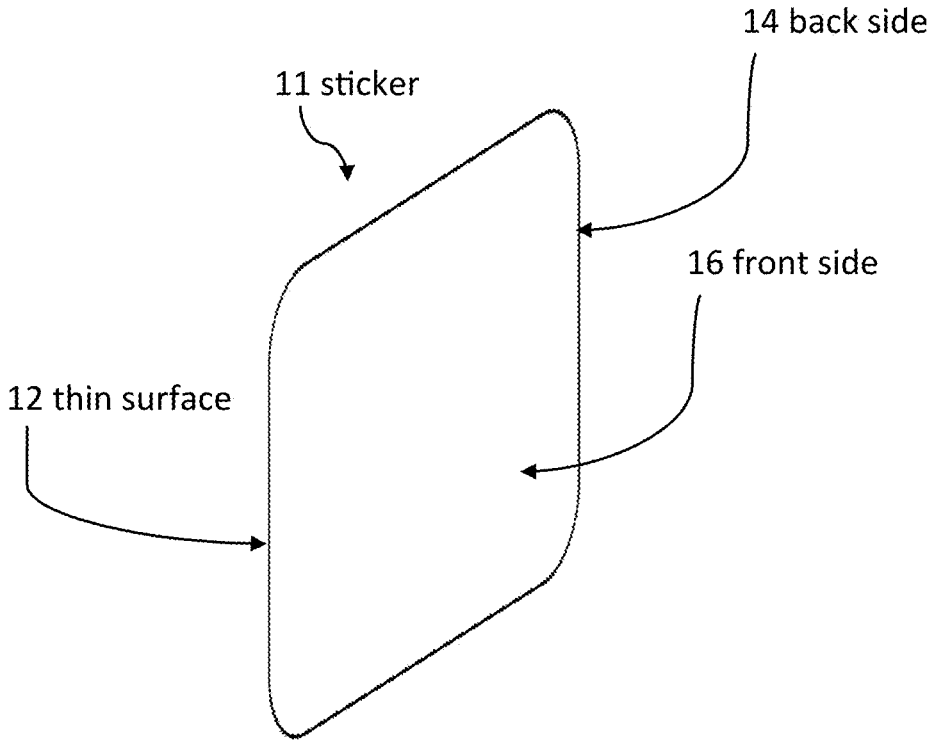
FIG. 2*b* illustrates a front side perspective view of a sticker, according to embodiments of the present disclosure.

As shown in FIG. 1, the document holder system 10 can include a sticker 11*a* that can further include a thin surface 12 elongate along a first direction X and a second direction Y. The second direction Y can be perpendicular to the first direction X. As further shown in FIGS. 2*a* and 2*b*, the thin surface 12 can include a back side 14 and a front side 16. It should be appreciated that the back side 14 faces opposite the front side 16.

Figure 3:
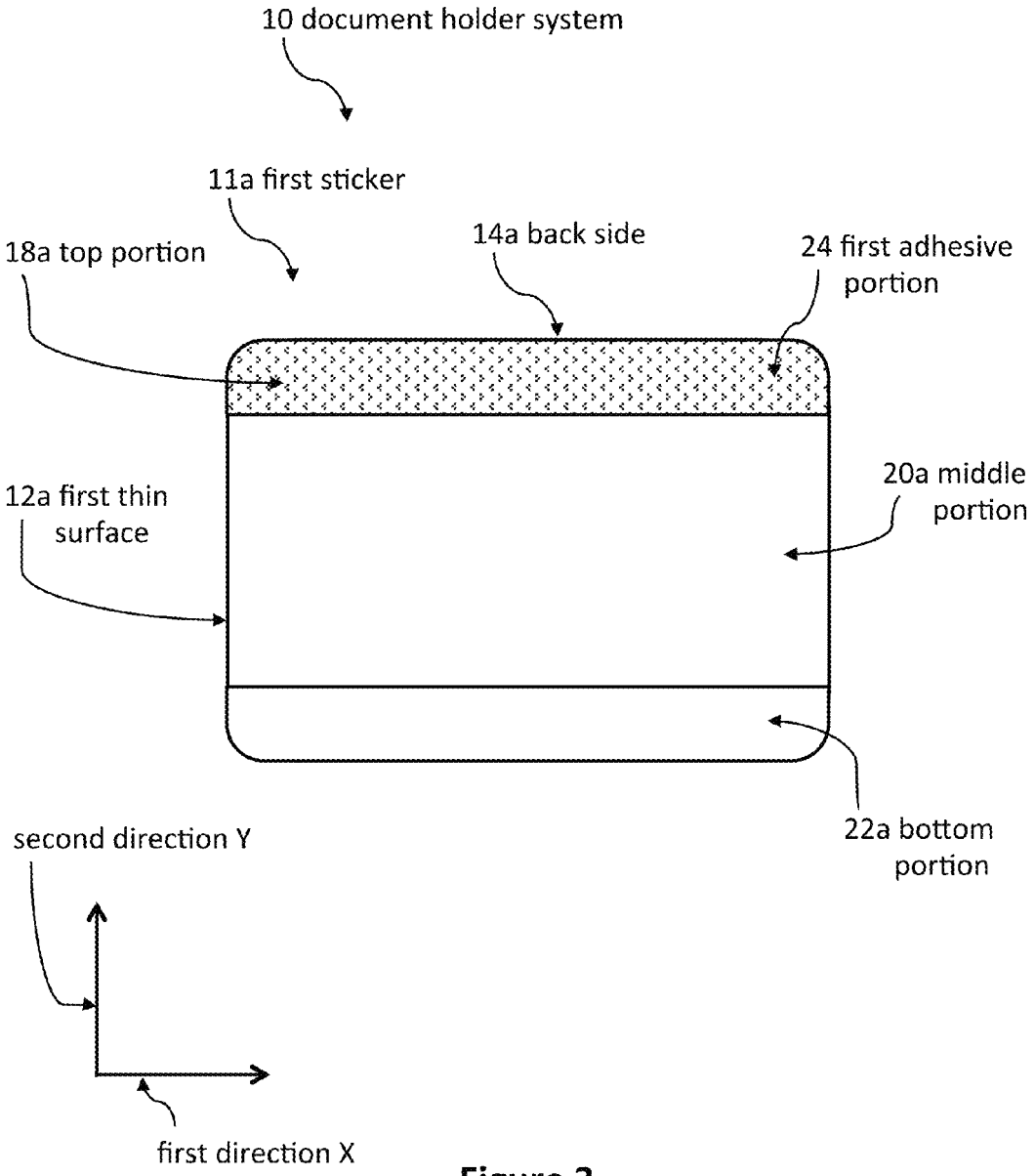
FIG. 3 illustrates a back side view of a first sticker, according to embodiments of the present disclosure.

With reference to FIG. 3, some embodiments of the sticker 11*a* can include a first adhesive portion 24 disposed on the back side 14*a* along a top portion 18*a* of the thin surface 12*a*. The first adhesive portion 24 can be used to adhesively attach the sticker 11*a* to other documents or surfaces, such as a brochure. In many embodiments, the adhesive, as implemented in the various adhesive portions, comprises a low-tack pressure-sensitive adhesive that can be easily attached, removed and re-posted without leaving residue on the substrate or document to which it is adhesively attached.

Figure 4:
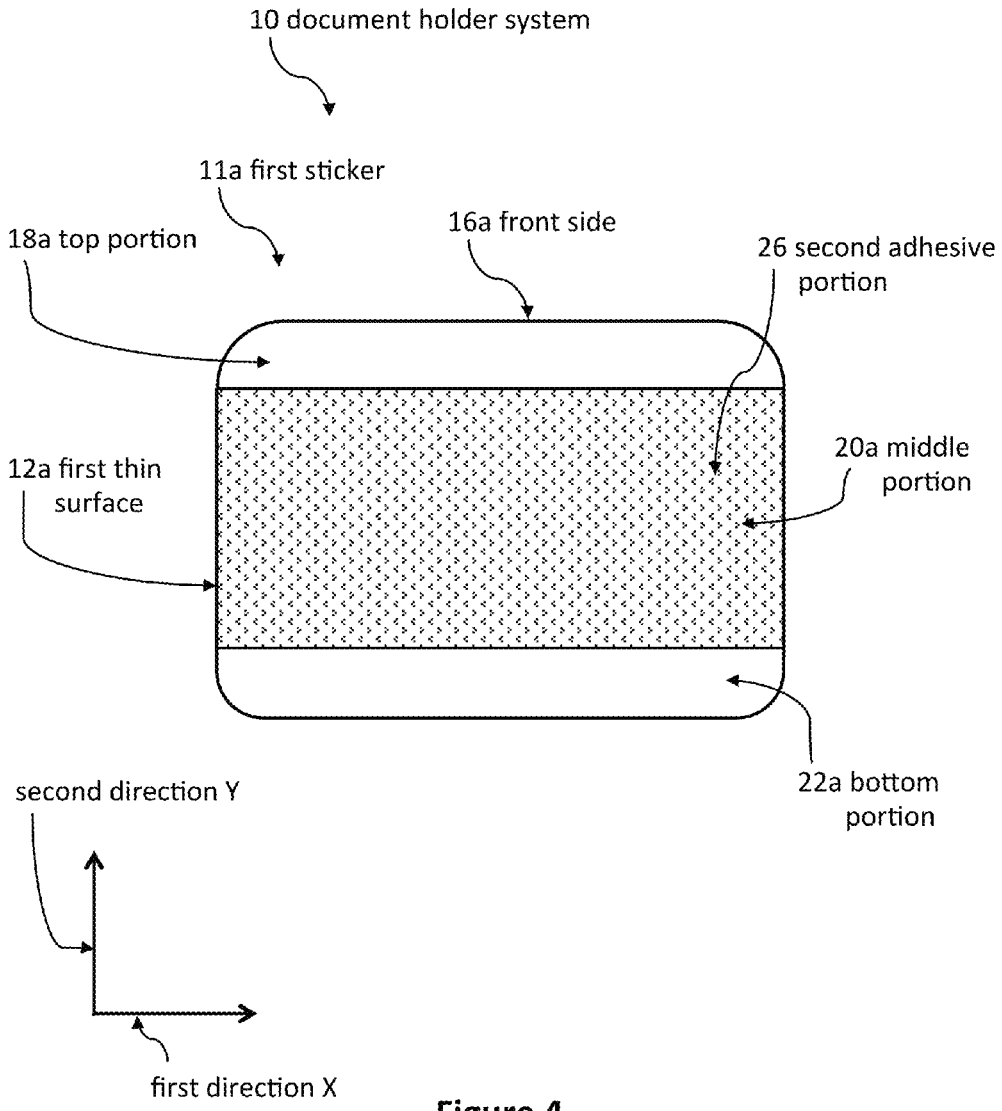
FIG. 4 illustrates a front side view of a first sticker, according to embodiments of the present disclosure.

The sticker 11*a* can also include a second adhesive portion 26 disposed on the front side 16*a*. FIG. 4 shows the second adhesive portion 26 disposed along a middle portion 20*a* of the sticker. However, it should be appreciated that the second adhesive portion 26 can also be disposed along the top portion 18*a* of the front side 16*a* as well. In some embodiments, the top portion and the middle portion do not overlap.

As illustrated in FIGS. 3 and 4, some embodiments of the sticker 11*a* can further include a bottom portion 22*a* located opposite the top portion 18*a*. The bottom portion 22*a* can be devoid of adhesive on both the front side 14*a* and the back side 16*a*. In this manner, the bottom portion 22*a* can receive notes or inscriptions, such as any type of hand-written or imprinted ink mark. In some embodiments, the bottom portion 22*a* and the middle portion 20*a* do not overlap.

Figure 5:
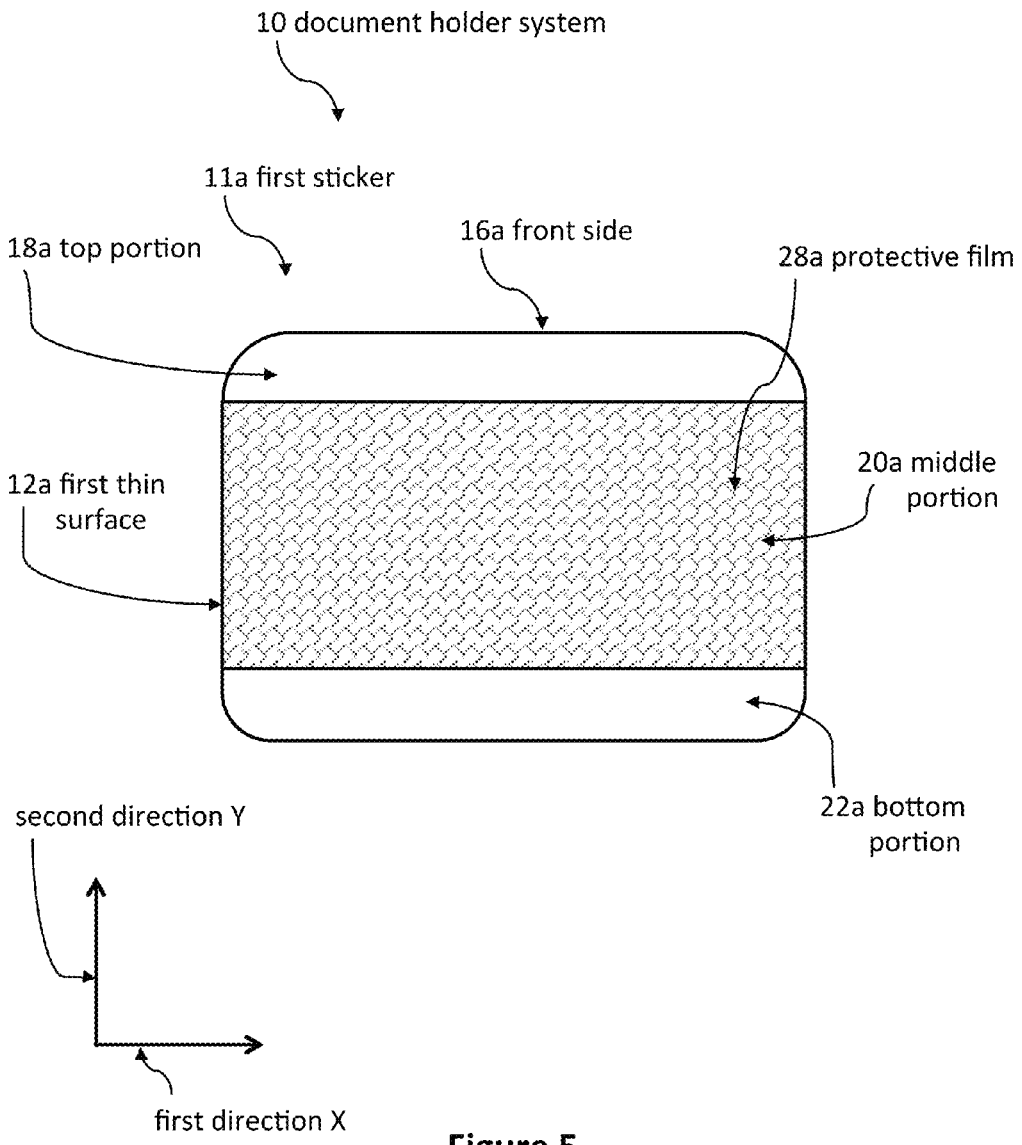
FIG. 5 illustrates a front side view of a first sticker having a protective film, according to embodiments of the present disclosure.

Now, with reference to FIG. 5, the document holder system 10 can include a first protective film 28*a* removably attached to the second adhesive portion 26 of the sticker 11*a*. In some embodiments, the first protective film does not cover any portion of the bottom portion 22*a* of the thin surface 12*a*, but may cover the top portion 18*a*. The first protective film 28*a* can be laid over the second adhesive portion 26 so as to prevent the second adhesive portion 26 from adhering to unwanted surfaces. In this manner, the exposed side of the first protective film 28*a* (the side not adhered to the second adhesive portion 26) can be a non-sticking surface that does not stick to other surfaces. If a person wants to adhesively attach a document to the second adhesive portion 26 of the sticker 11*a*, the person can thereby remove the first protective film 28*a* from the sticker 11*a*.

Figure 6:
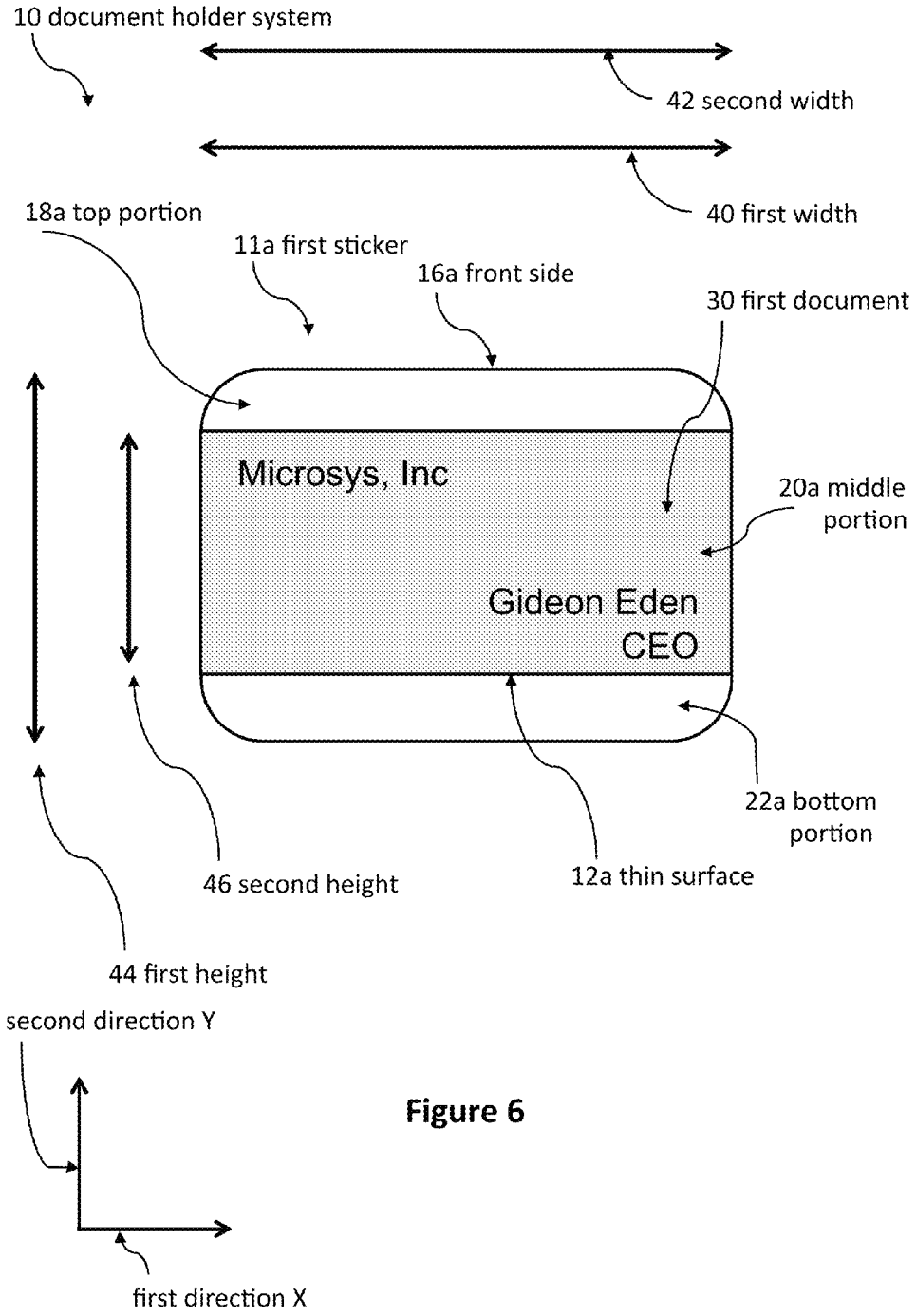
FIG. 6 illustrates a front side view of a first sticker with a document attached therewith, according to embodiments of the present disclosure.

Accordingly, as shown in FIG. 6, once the first protective film 28*a* is removed, the document holder system 10 can further include a first document 30 adhesively attached to the second adhesive portion 26. The second adhesive portion 26 can be configured to release the first document 30 without damaging the first document. In this manner, the first document can be adhesively attached to the second adhesive portion 26 and later removed without damage to either the first document or the sticker 11*a*.

As further shown in FIG. 6, the first thin surface 11*a* can define a first width 40 and a first height 44. In some embodiments, the first document 30 defines a second width 42 that is greater than or equal to the first width 40 and the first document 30 defines a second height 46 that is greater than or equal to the first height 44. In some embodiments, the second width 42 is less than or equal to the first width 40 and the second height 46 that is less than or equal to the first height 44. In some embodiments, the first document is a business card whereby the second width equals approximately 3.5 inches and the second height equals approximately 2.0 inches.

Figure 7:
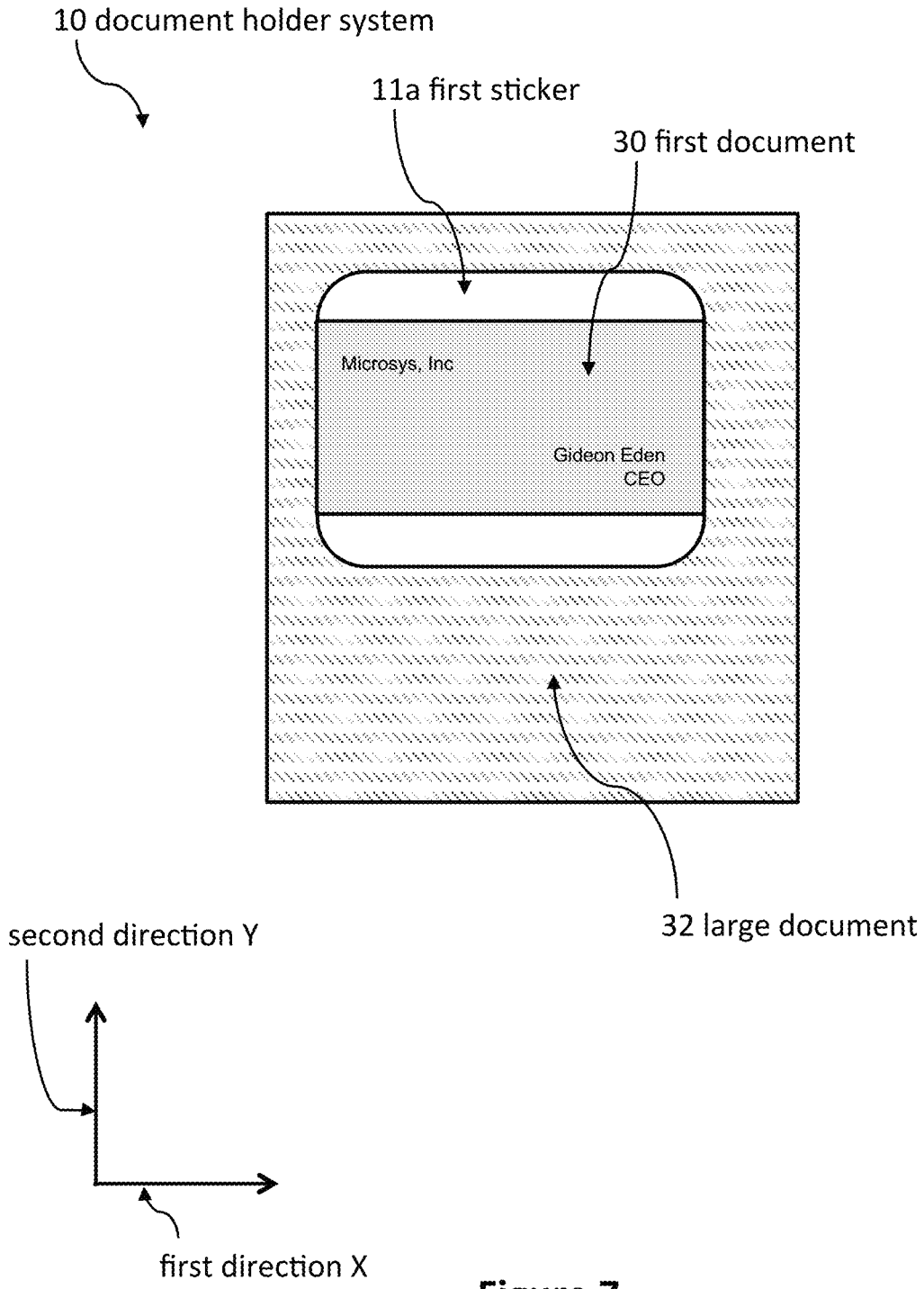
FIG. 7 illustrates a front side view of a first sticker attached to a large document, according to embodiments of the present disclosure.

With reference to FIG. 7, the sticker 11*a* can be adhesively attached to a large document 32, such as a brochure or sheet of paper, via the first adhesive portion 24. The large document 32 can define a width that is greater than the first width 40. Additionally, the large document 32 can define a height that is greater than the first height 44. It should be appreciated that the first adhesive portion 24 can be configured to release the large document 32 without damaging the large document 32.

Figure 8:
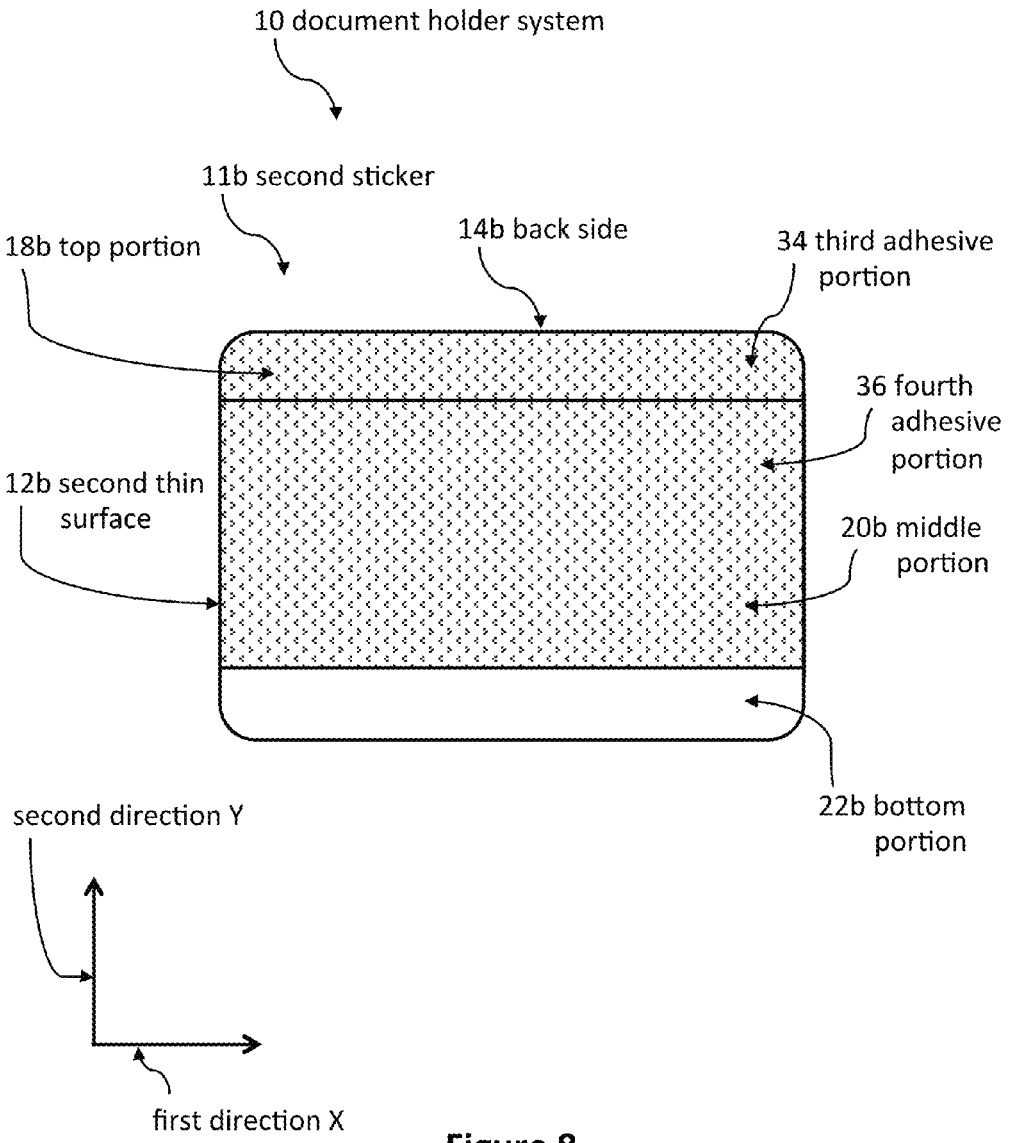
FIG. 8 illustrates a back side view of a second sticker, according to embodiments of the present disclosure.

Now, with reference to FIG. 8, the document holder system 10 can include other types of stickers 11. In some embodiments, the document holder system 10 includes a sticker 11*b*, which includes a second thin surface 12*b* elongate along a first direction X and a second direction Y that is perpendicular to the first direction X. The sticker 11*b* can include a third adhesive portion 34 disposed on the back side 14*b* along a top portion 18*b* of the second thin surface 12*b*. Even still, the sticker 11*b* can include a fourth adhesive portion 36 disposed on the back side 14*b* along a middle portion 20*b* of the second thin surface 12*b*. In some embodiments, the top portion 18*b* and the middle portion 20*b* do not overlap.

Figure 9:
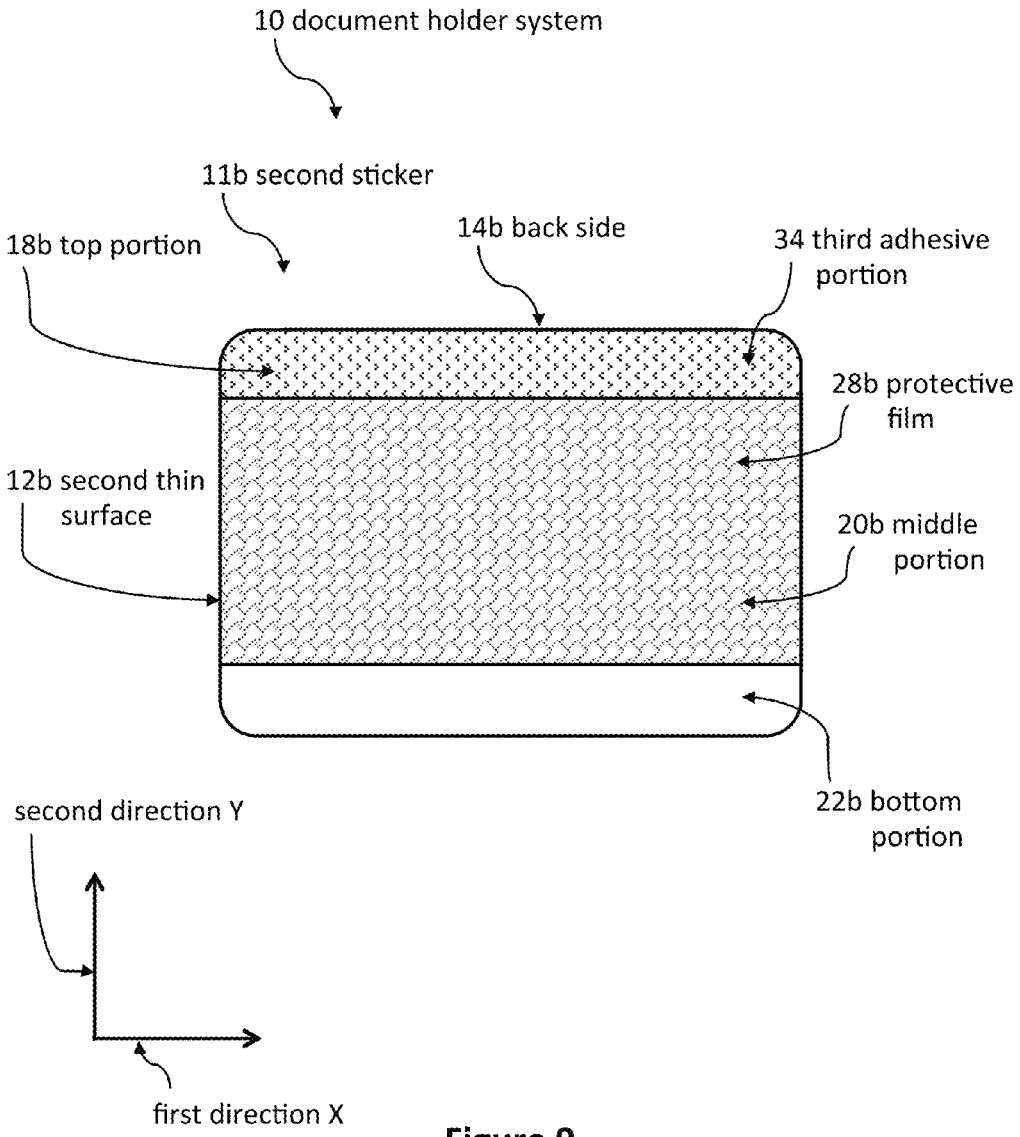
FIG. 9 illustrates a back side view of a second sticker having a protective film, according to embodiments of the present disclosure.

As illustrated in FIG. 9, the document holder system 10 can further include a protective film 28*b* removably attached to the fourth adhesive portion 36. The document holder system 10 can further include a business card adhesively attached to the fourth adhesive portion 36. In some embodiments, the fourth adhesive portion 36 is configured to release the business card without damaging the business card. The fourth adhesive portion 36 can define an area less than or equal to an area of the document, such as the business card. In some embodiments, the fourth adhesive portion 36 defines an area greater than or equal to the area of the document, such as the business card. Generally speaking, the area of the adhesive portion that receives the document, such as the business card, can be greater than, lesser than, or equal to the area of the business card.

Figure 10:
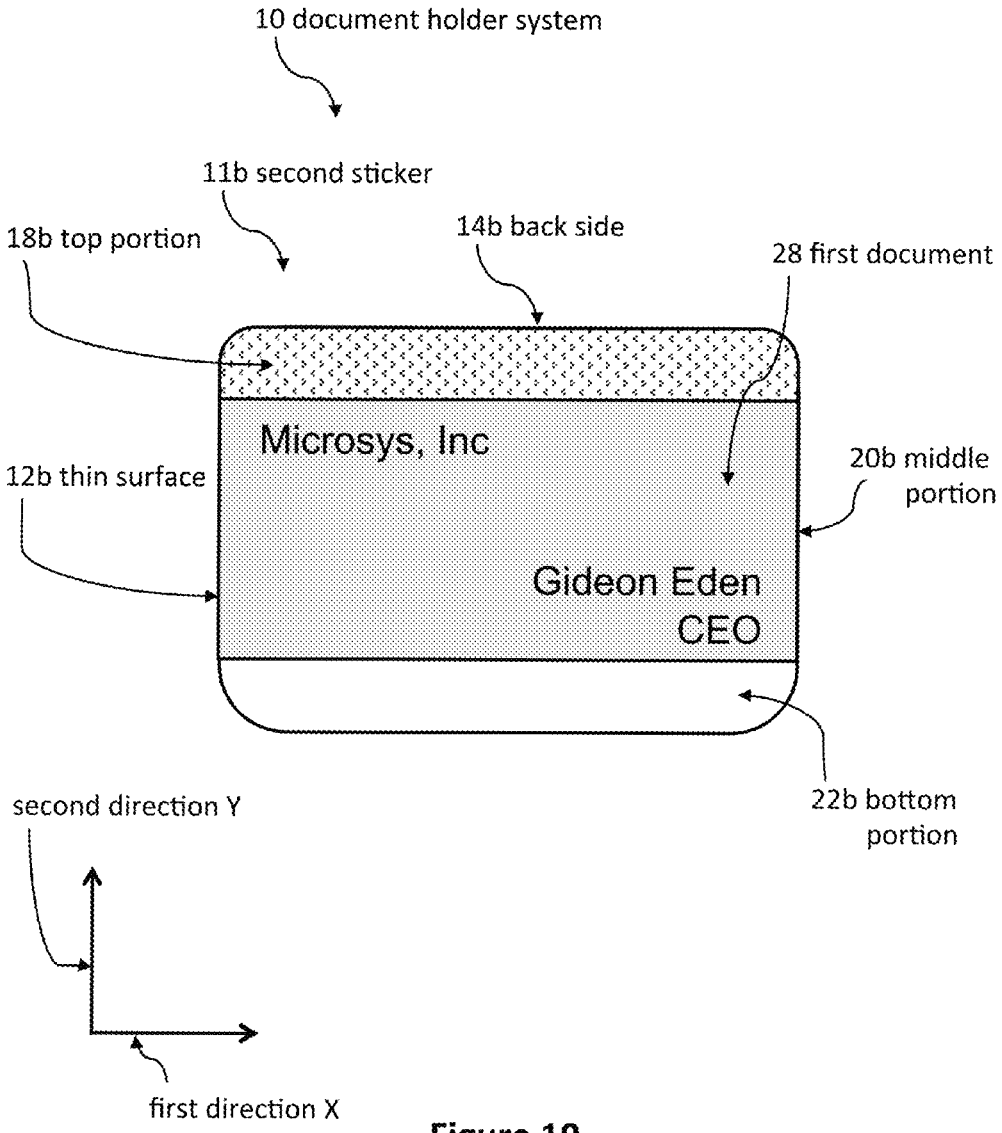
FIG. 10 illustrates a back side view of a second sticker with a document attached therewith, according to embodiments of the present disclosure.
Figure 11:
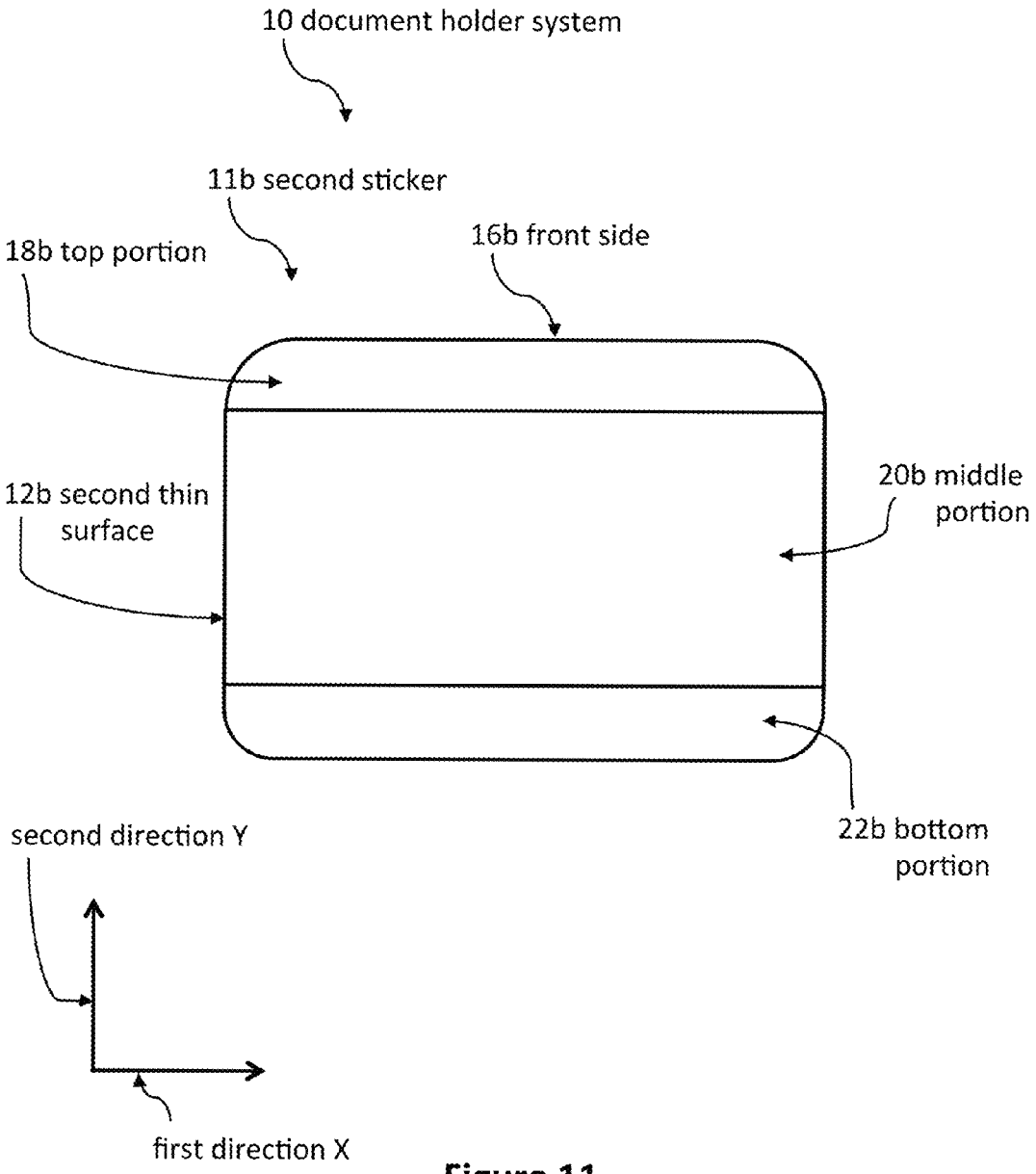
FIG. 11 illustrates a front side view of a second sticker, according to embodiments of the present disclosure.

As previously described, and as shown in FIG. 10, the protective film 28*b* can be removed, whereby the fourth adhesive portion 36 can receive a first document 30, such as a business card. Because the back side 14*b* of the sticker 11*b* can include the third and fourth adhesive portions 34, 36, the front side 16*b* can be devoid of adhesive, as shown in FIG. 11. In this regard, the front side 16*b* can be configured to receive notes and inscriptions, such as the location, time, and other pertinent information regarding a meeting between a first person and a second person who's name and contact information is disclosed on the business card.

Figure 12:
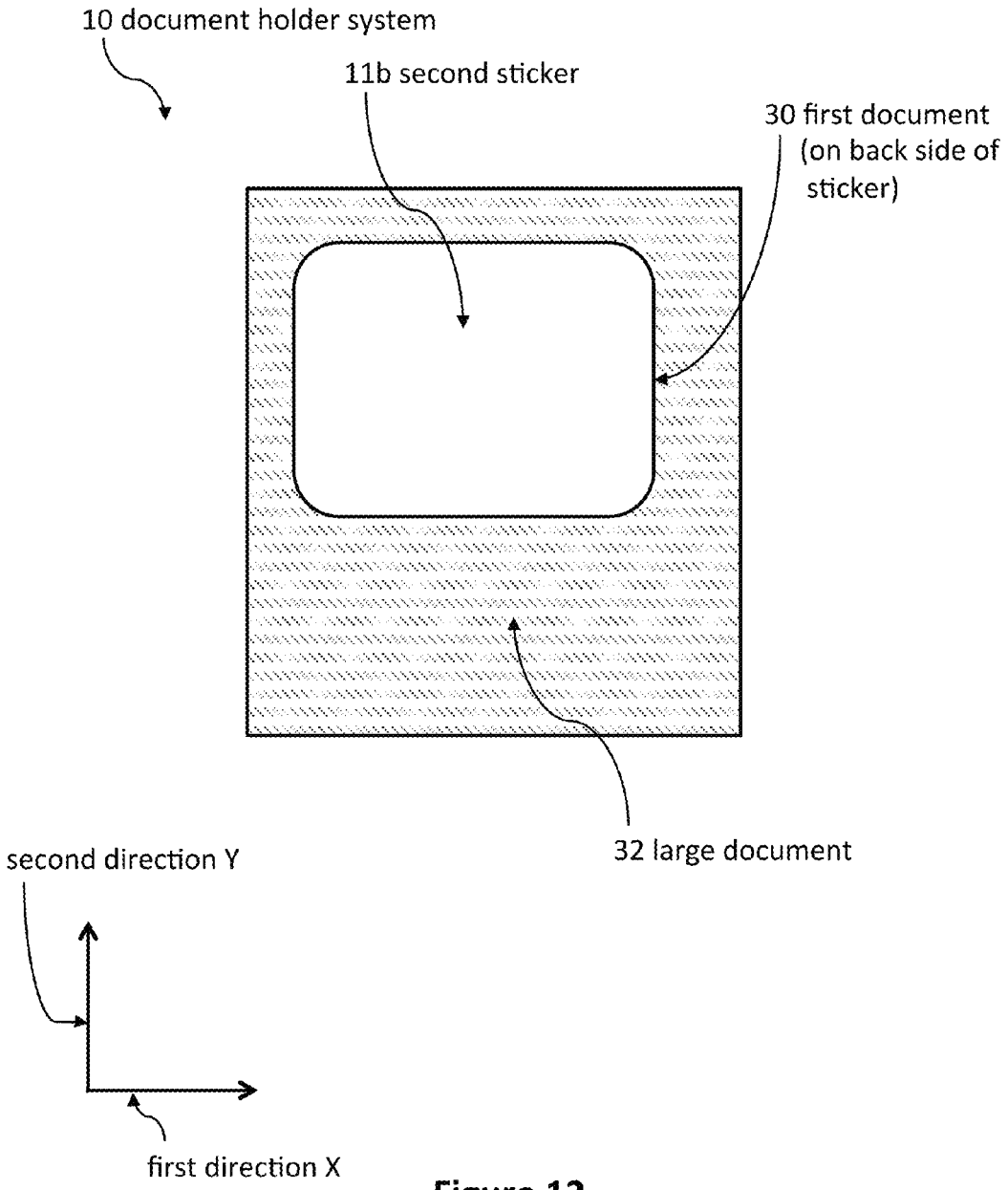
FIG. 12 illustrates a front side view of a second sticker attached to a large document, according to embodiments of the present disclosure.

As shown in FIG. 12, the third adhesive portion 34 can be adhesively attached to a large document 32 to thereby adhere the sticker 11*b* to the large document 32. It should be appreciated that the third adhesive portion 34 can be configured to release the large document 32 without damaging the large document 32. In some embodiments, the large document defines a fifth width that is greater than the first width 40, as well. Furthermore, in some embodiments, the large document can define a fifth height that is greater than the first height 44.

Figure 13:
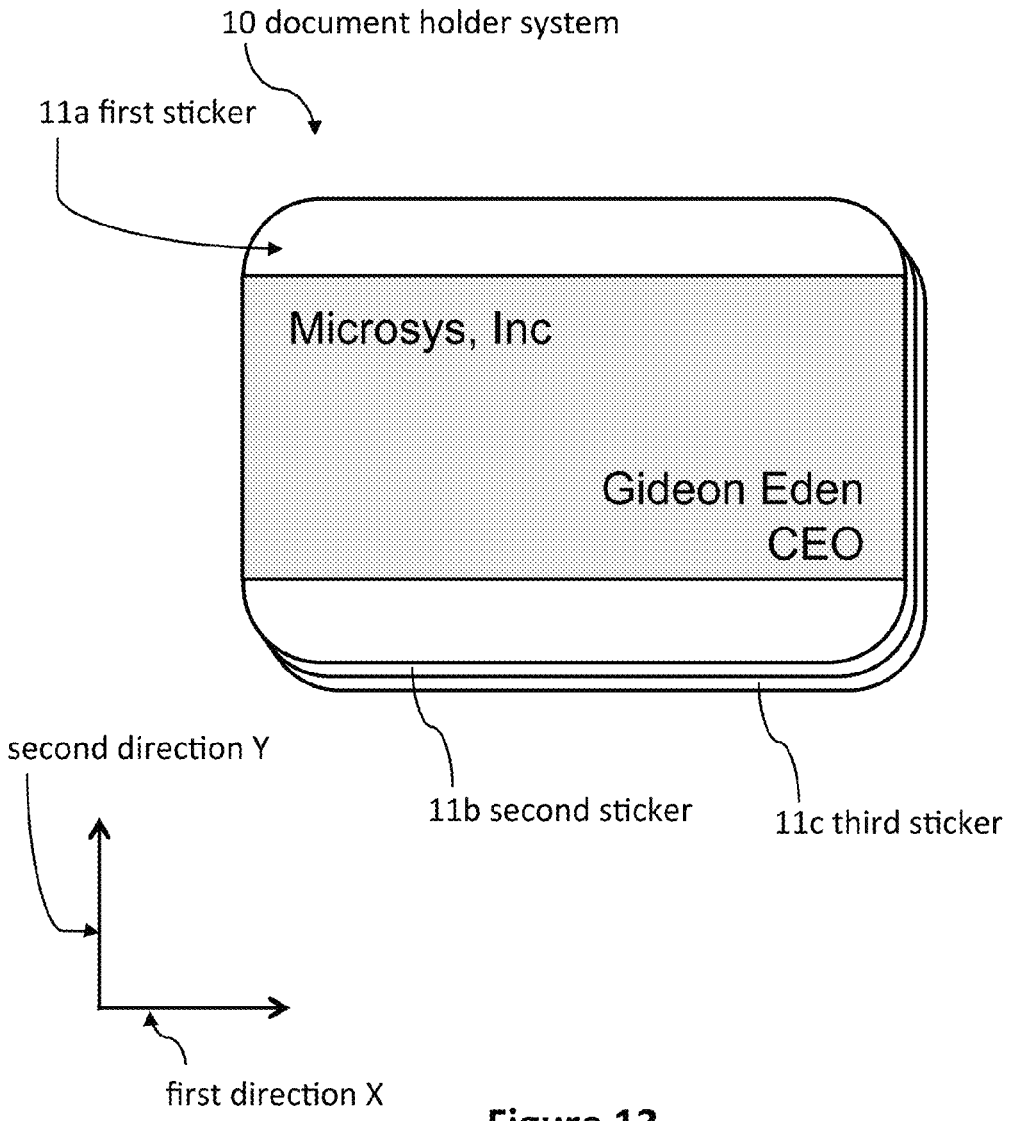
FIG. 13 illustrates a document holder system having a plurality of stickers, according to embodiments of the present disclosure.

FIG. 13 illustrates that the document holder system 10 can include a plurality of stickers 11. In some embodiments, the document holder system 10 can include the first sticker 11*a*, the second sticker 11*b*, and even a third sticker 11*c* Generally, it should be appreciated that the document holder system 10 can include any number of stickers. Additionally, the document holder system 10 can include any different type of stickers, such as all first stickers 11*a* (as previously described), all second stickers 11*b* (as previously described), and even a mix of some first stickers 11*a* and some second stickers 11*b*.

Furthermore, in some embodiments, the document holder system 10 includes stickers organized in various configurations and patterns. For example, the document holder system 10 can include stickers organized in a first pattern (from top to bottom) that includes a first sticker 11*a*, then a second sticker 11*b* directly below the first sticker 11*a*, then a first sticker 11*b* directly below the second sticker 11*b*, then a first sticker 11*a* directly below the second sticker 11*b*, etc. This can allow users to inscribe notes onto the bottom portions 22 or even on the middle portions 20 without leaving dents or inscriptions on the document or business card located on the sticker 11 directly below it. Furthermore, it should be appreciated that any type of configuration or pattern can be implemented in the document holder system 10.

Interpretation

It should be appreciated that the terms "first adhesive portion" and "third adhesive portion" can refer to the same portions and can thereby be used interchangeably. Additionally, the terms "second adhesive portion" and "fourth adhesive portion" can refer to the same portions and can thereby be used interchangeably.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments include A, B, and C. The term "and/or" is used to avoid unnecessary redundancy.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the inventions disclosed herein.

The following is claimed:

1. A document holder system, comprising:

a thin surface elongate along a first direction and a second direction that is perpendicular to the first direction, wherein the thin surface comprises a front side and a back side that faces opposite the front side, and wherein the thin surface defines a top portion, a bottom portion located opposite the top portion, and a middle portion that does not overlap the top portion and the bottom portion;

a first adhesive portion disposed on the back side along the top portion; and a second adhesive portion disposed on the front side along at least one of the top portion and the middle portion, wherein the bottom portion is devoid of adhesive on both the front side and the back side.

2. The document holder system of claim 1, wherein the thin surface is selected from the group consisting of paper, polymer, and fabric.

3. The document holder system of claim 2, wherein the thin surface defines a first width and a first height, wherein the first adhesive portion is adhesively attached to a large document that defines a width that is greater than the first width and the large document defines a height that is greater than the first height, and wherein the first adhesive portion is configured to release the large document without damaging the large document.

4. The document holder system of claim 2, wherein the thin surface defines a first width and a first height, the system further comprising a first document adhesively attached to the second adhesive portion, wherein the second adhesive portion is configured to release the first document without damaging the first document.

5. The document holder system of claim 4, wherein the first document comprises a business card.

6. The document holder system of claim 4, wherein the thin surface is a first thin surface, the system further comprising:

a second thin surface elongate along the first direction and the second direction, wherein the second thin surface comprises a front side and a back side that faces opposite the front side;

a third adhesive portion disposed on the back side along a top portion of the second thin surface; and a fourth adhesive portion disposed on the front side along at least one of the top portion of the second thin surface and a middle portion of the second thin surface, wherein the top portion of the second thin surface and the middle portion of the second thin surface do not overlap, wherein the first adhesive portion of the first thin surface is adhesively attached to a top portion of the front side of the second thin surface, wherein the first adhesive portion is configured to release the second thin surface without damaging the second thin surface.

7. The document holder system of claim 6, further comprising a second document adhesively attached to the fourth adhesive portion, wherein the fourth adhesive portion is configured to release the second document without damaging the second document.

8. The document holder system of claim 4, wherein the thin surface is a first thin surface, the system further comprising:

a second thin surface elongate along the first direction and the second direction, wherein the second thin surface comprises a front side and a back side that faces opposite the front side;

a third adhesive portion disposed on the back side along a top portion of the second thin surface; and a fourth adhesive portion disposed on the back side along a middle portion of the second thin surface, wherein the top portion and the middle portion do not overlap, wherein the first adhesive portion of the first thin surface is adhesively attached to a top portion of the front side of the second thin surface, wherein the first adhesive portion is configured to release the second thin surface without damaging the second thin surface.

9. The document holder system of claim 8, further comprising a second document adhesively attached to the fourth adhesive portion, wherein the fourth adhesive portion is configured to release the second document without damaging the second document.

10. The document holder system of claim 9, wherein the first thin surface is detached from the second thin surface, and wherein the first adhesive portion is adhesively attached to a large document that defines a fifth width that is greater than the first width and the large document defines a fifth height that is greater than the first height, and wherein the first adhesive portion is configured to release the large document without damaging the large document.

11. The document holder system of claim 1, wherein the thin surface is a first thin surface, and the second adhesive portion is located on the front side along the top portion, the system further comprising:

a second thin surface elongate along the first direction and the second direction, wherein the second thin surface comprises a front side and a back side that faces opposite the front side;

a third adhesive portion disposed on the back side along a top portion of the second thin surface; and a fourth adhesive portion disposed on the front side along a top portion of the second thin surface, wherein the first adhesive portion of the first thin surface is adhesively attached to the top portion of the front side of the second thin surface, wherein the first adhesive portion is configured to release the second thin surface without damaging the second thin surface.

12. A document holder system, comprising:

a thin surface elongate along a first direction and a second direction that is perpendicular to the first direction, wherein the thin surface comprises a front side and a back side that faces opposite the front side, and wherein the thin surface defines a top portion, a bottom portion located opposite the top portion, and a middle portion that does not overlap the top portion and the bottom portion;

a first adhesive portion disposed on the back side along the top portion; and a second adhesive portion disposed on one of the front side and the back side along the middle portion, wherein the bottom portion is devoid of adhesive.

13. The document holder system of claim 12, wherein the bottom portion is configured to receive hand-written notes from a writing instrument.

14. The document holder system of claim 13, further comprising a business card adhesively attached to the second adhesive portion, wherein the second adhesive portion is configured to release the business card without damaging the business card.

15. The document holder system of claim 13, further comprising a first protective film removably attached to the second adhesive portion.

16. The document holder system of claim 15, wherein the first protective film is removed from the second adhesive portion, the document holder further comprising a business card adhesively attached to the second adhesive portion, wherein the second adhesive portion is configured to release the business card without damaging the business card.

17. The document holder system of claim 15, wherein the thin surface is a first thin surface, the system further comprising:

a second thin surface elongate along the first direction and the second direction, wherein the second thin surface comprises a front side and a back side that faces opposite the front side;

a third adhesive portion disposed on the back side along a top portion of the second thin surface;

a fourth adhesive portion disposed on one of the front side and the back side along a middle portion of the second thin surface, wherein the top portion and the middle portion do not overlap, wherein the first adhesive portion of the first thin surface is adhesively attached to the top portion of the front side of the second thin surface, and wherein the first adhesive portion is configured to release the second thin surface without damaging the second thin surface; and a second protective film removably attached to the fourth adhesive portion.

18. The document holder system of claim 15, wherein the thin surface is a first thin surface, the system further comprising:

a second thin surface elongate along the first direction and the second direction, wherein the second thin surface comprises a front side and a back side that faces opposite the front side;

a third adhesive portion disposed on the back side along a top portion of the second thin surface;

a fourth adhesive portion disposed on the front side along at least one of the top portion of the second thin surface and a middle portion of the second thin surface, wherein the top portion of the second thin surface and the middle portion of the second thin surface do not overlap, wherein the first adhesive portion of the first thin surface is adhesively attached to the top portion of the front side of the second thin surface, and wherein the first adhesive portion is configured to release the second thin surface without damaging the second thin surface; and a second protective film removably attached to the fourth adhesive portion.

19. The document holder system of claim 12, wherein the bottom portion is configured to receive hand-written notes from a writing instrument.

* * * * *